United States Patent [19]

Ovsttun

[11] 3,961,488

[45] June 8, 1976

[54] METHOD FOR FILLING AND EMPTYING OF CASSIONS

[75] Inventor: Torbjorn Ovsttun, Oslo, Norway

[73] Assignee: A/S Akers Mek. Verksted, Norway

[22] Filed: Nov. 19, 1974

[21] Appl. No.: 525,252

[52] U.S. Cl. ..... 61/46; 137/236

[51] Int. Cl.[2] ..... E02B 1/00; E02D 23/00

[58] Field of Search ..... 61/46, .5, 46.5; 114/.5 T; 137/154, 236

[56] References Cited

UNITED STATES PATENTS

| | | | |
|---|---|---|---|
| 422,848 | 3/1890 | De St. Aubin et al. | 137/154 |
| 3,146,458 | 8/1964 | Estes et al. | 61/46.5 |
| 3,488,969 | 1/1970 | Lacy, Jr. | 61/.5 |
| 3,605,774 | 9/1971 | Launay et al. | 61/46 |
| 3,667,240 | 6/1972 | Vilain | 61/.5 |
| 3,727,418 | 4/1973 | Glazier | 61/46 |

*Primary Examiner*—Paul R. Gilliam
*Assistant Examiner*—Alexander Grosz
*Attorney, Agent, or Firm*—Watson, Cole, Grindle & Watson

[57] ABSTRACT

An arrangement is provided for the filling and emptying by gravitational means of caissons having oil stored therein, the caissons being filled to capacity with water and/or oil and being located below the level of a body of water. Containers are provided which are also disposed below the level of the body of water but above the level of the caissons, one of the containers containing oil being connected with the caissons through top portions thereof and another of the containers containing water being connected with the caissons through bottom portions thereof so that the caissons may be emptied of and filled with oil under the forces of gravity as the level of water in such other container is regulated to a level respectively higher and lower than the oil level in said one container.

9 Claims, 4 Drawing Figures

METHOD FOR FILLING AND EMPTYING OF CASSIONS

Drilling for oil and the exploitation of oil resources under the sea bed mainly near the mainland and at modest depths have been in progress for many years. The oil is mainly transported through pipelines resting on the sea bed directly to storage tanks ashore.

In recent years the technical development of drilling equipment and drilling engineering has made it possible to exploit undersea oil resources at ever increasing depths of water and distances from the shore with the consequent development of new methods and equipment for use at the actual wellhead in the open sea and for the landing of the products.

For preference, at these great depths of water, a single well is first drilled down to the assumed deposits, and preferably from a floating drilling unit which is moved to a new drilling location when any oil and/or gas deposits have been found, or the well has been found to be dry, a so-called wild-cat and the wellhead are properly secured and furthermore provided with the necessary equipment for subsequent localization, so that the so-called production platform can be arranged preferably above and in direct connection with the well for the drilling of further wells, vertical or at angles in various directions and to varying depths in the field.

It is not unusual to drill for example 60 holes from a production platform of this kind. When the drilling of each separate well has been completed a certain procedure is carried out in order to achieve production at the earliest possible time before the well is connected to the production network, e.g. for the landing of the product through pipelines, by tankers or the like, or by other suitable means and for other fields of use. By and large production in this introductory phase of the exploitation of oil resources involves relatively small quantities and it is thus desireable and to some extent necessary at this time to store the product from the well on site until it is economically and practicably possible to land the product. To no little degree, oil storage of this kind will promote drilling operations until a pipeline for landing has been laid to the wellhead or a loading point, for e.g., tankers or the like.

Thus it is expedient to store the oil at the drilling site in close connection with a production platform, especially during the initial period of exploitation of the oil deposit, and in addition it is of great importance during subsequent continuous operation to have facilities for buffer storage, for use e.g. in the case of interruption of landing operations or the like.

The storage of hydrocarbons such as oil at great sea depths involves problems which by means of hitherto known procedures have only been partly solved in a technically satisfactory manner.

The use of concrete in storage tanks and supporting units is a natural technical development at these depths, but pores and large or small cracks may be formed after a relatively short period of use and the risk of leakage is always present. There is absolutely no possibility of effecting repairs or the like to such leaks, and even in the case of quite small leaks the whole or parts of the storage systems must be closed down. There are strict environmental requirements as regards protection against leakage of whatever kind and under adverse circumstances users may be ordered to close down complete storage systems, resulting in heavy capital and production losses.

Varying and often low water temperatures at great depths in the sea affect the viscosity of the oil and when pumps are used to ensure reliable movement of oil from these locations to the surface of the sea for onward transportation this reduced viscosity necessitates over-dimensioned pump capacity entailing large investments and costly power consumption.

Storage containers at such sea depths are exposed to extremely heavy hydrostatic stresses, and preferably such containers should therefore at all times be filled with water or oil proportions of these two substances. The lighter hydrocarbons will float on the top of the water which is added to or removed from the container in accordance with the desired quantity of oil to be stored. The use of pumps for the supply and removal of water or oil from storage tanks involves undesirable emulsifying effects and such a system is not very practicable at great depths. Similarly, employment of the external hydrostatic water pressure using a free or open connection between the interior of the container and the ambient water is impracticable due to the aforesaid environmental restrictions.

The purpose of the invention is to provide a storage installation which eliminates the deficiencies of the hitherto known installations of a similar nature.

In the following, a production platform of the kind which rests on the sea bed and is equipped for the storage of oils is described as a platform with a deck supported by one or more supporting columns extending from storage containers resting on the sea bed, hereinafter called caissons, up above the surface of the sea and carrying a deck at sufficient height above sea level to avoid the effects of the biggest waves occuring in the area. The caissons are preferably vertical cylinders, two or more joined together as units, but the invention can also be employed in the case of other forms of platform, caisson or other types of storage systems.

The system according to the invention is characterized in that the internal pressure in the caissons is at all times maintained lower than the hydrostatic pressure acting on the outsides of the caissons, irrespective of level. The system works on the principle of water displacement employing gravity in connection with the fact that oil is of lower relative density than water which is supplied to the system from a level below the surface of the sea determined in advance and dependent upon the depth of the sea and the desired lower pressure within the caissons. For example, an underpressure of 3 at. in the caissons is obtained by feeding water to the system from a point lying 30 m below the surface of the sea.

Thus when the caissons are sited at a depth of 200 m the internal pressure in the caissons will be about 17 at. while the ambient hydrostatic pressure is about 20 at. Due to this difference in pressure any leakage in the caissons will result in ambient sea water being forced into the caissons through the leak, preferably by displacement of oil out of the caisson through pipe connections up to a level similarly below the surface of the sea whence the oil is transported to storage tanks for this purpose. The system according to the invention also comprises automatic devices to ensure that filling and emptying of liquids into and out of the caissons is under control at all times. Other characteristics of the invention will appear from the detailed description.

Storage tanks the caissons are always filled with water, oil or water and oil in any proportions thus ensuring that there is never any form of gas/air at the top of the caisson. Any air in the caisson before and during sinking operations can be removed from the caisson through pipe connections during such operations until the caisson is filled with water which fills the caisson to capacity.

The invention will be further described with reference to the drawings in which.

Figure 1:
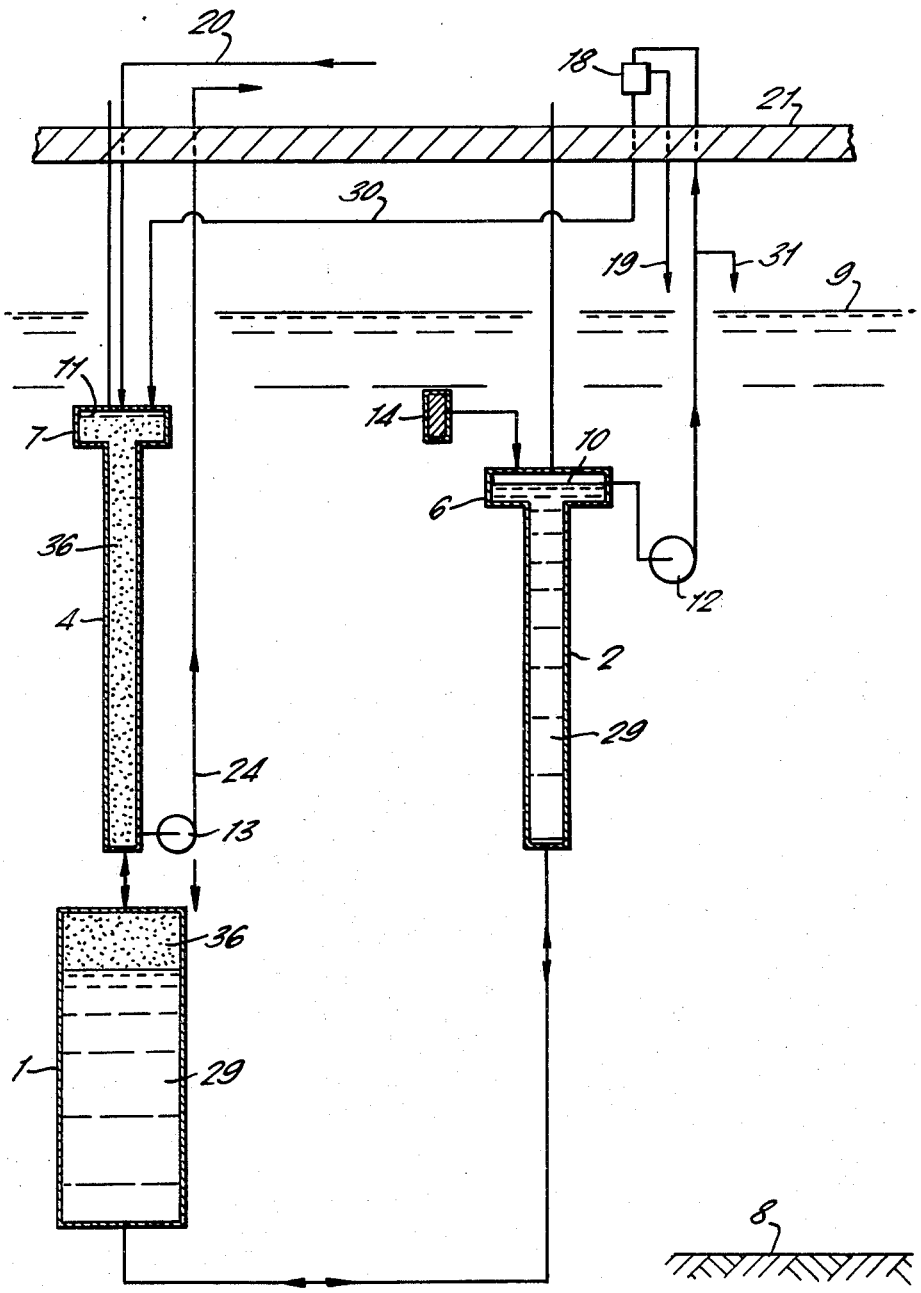
FIG. 1 is a diagrammatic illustration of a simplified embodiment of the system according to the invention.

FIG. 1 shows in diagrammatic form a simplified system in accordance with the invention comprising equalization tanks for oil and water preferably disposed internally in a supporting column of a platform at a depth below the surface of the sea chosen to suit the desired under-pressure in the caissons. The platform and the caissons per se do not comprise any part of the present invention, but are included in a preferred embodiment.

Figure 2:
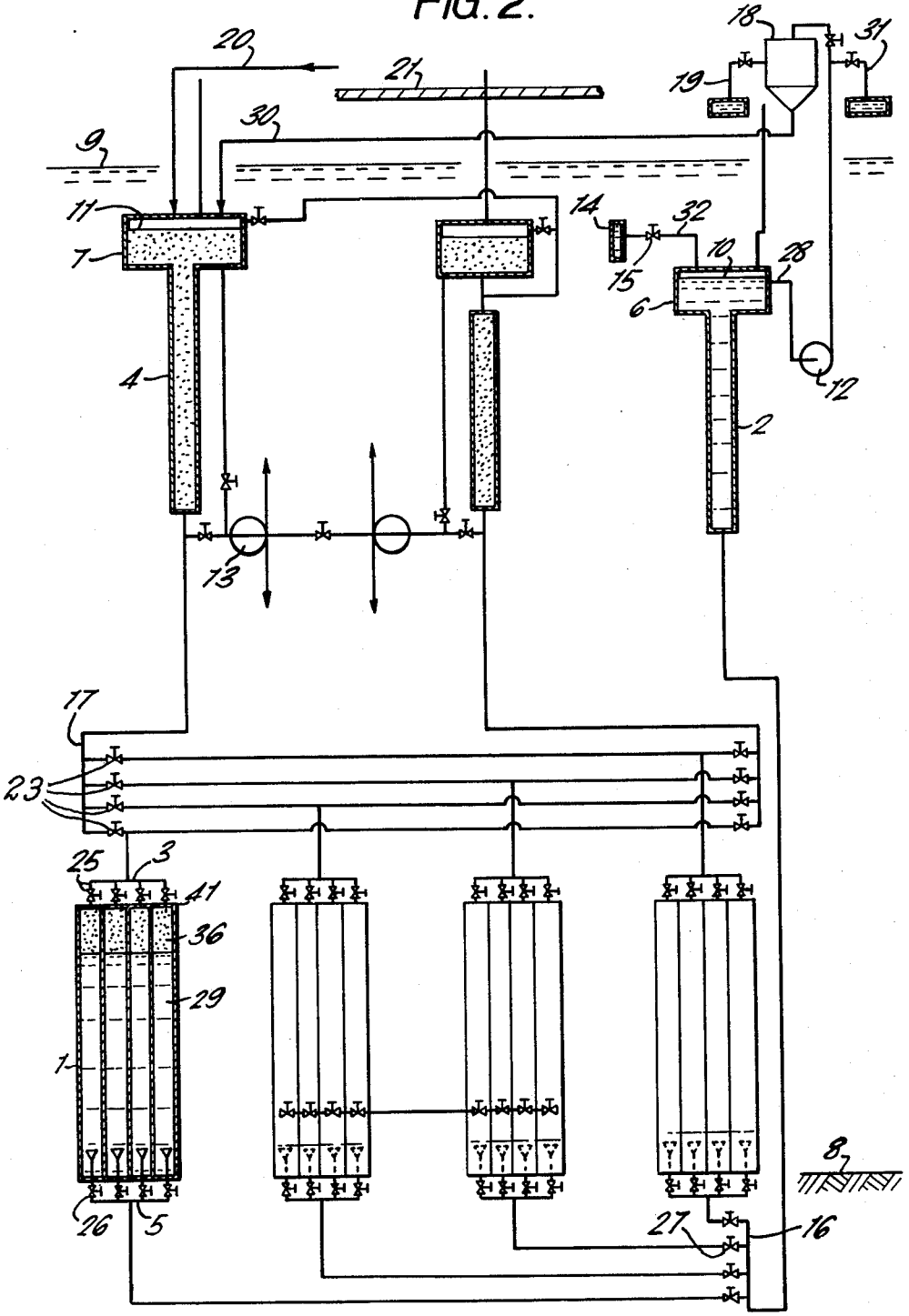
FIG. 2 is a diagrammatic illustration of a suitable connection of caissons in groups with a control system for the filling and emptying of liquids which will not mix with water.

FIG. 2 shows in principle the arrangements for filling with oil the caissons 1 resting on the sea bed, and removing oil from them. In the example shown four caissons are interconnected so that the main oil feed pipes and distribution pipes 3 are common, the main water feed pipe and distribution pipes 5 similarly being common for the caissons shown. There is nothing to prevent oil and water in the two supply pipes from being distributed by means of valves to a greater or smaller number of caissons or separately to each individual caisson, but out of regard for the stability of the platform and requirements in respect of minimum deviation of columns from the vertical position it is expedient to be able to distribute the removal of oil and feeding of water or vice versa to greater or lesser areas, i.e., to a greater or lesser number of inter-connected caissons. Mainly the relative density of the oil varies between 0.8 and 0.85 and in the present example it has been assumed to be 0.83. Each of the caissons shown in FIG. 1 are of large capacity, for example about 30 m in diameter and about 50 m tall, and there is thus a considerable difference in weight between oil and water which can be employed in the adjustment of the vertical position of the columns if this should change, especially after the wells have been brought into full production and the caissons are mainly employed as ballast tanks and where a displacement of the distribution of weight in the course of time may cause parts of the total caisson unit to penetrate further down into the sea bed in order to attain the desired vertical positions of the supporting columns.

The depth at which level 10 is to be employed depends upon the degree of under-pressure required to be maintained in the caissons 1. In the present example a water tank 6 is arranged with its working water level 10 about 30 m below the surface of the sea. An oil tank 7 is similarly arranged below the surface of the sea, but at a higher level than the tank 6 and corresponding to the height to which the oil is forced due to the greater relative density of the water, indicated at 11, which is the normal working level of the oil. In the example the tanks 6 and 7 are shown arranged in close connection with vertically disposed equalization columns 2 for water and 4 for oil, but they can also take the form of direct extensions of these without any increase of capacity. It may be expedient to provide more than one of each of the columns 2 and 4 for the supply of liquid from tanks 6 and 7 in order to maintain constant levels, and this can naturally also be achieved if each separate column has its own separate upper tank directly connected to the respective columns, that the columns themselves form the tanks as described above or that the respective tanks are connected to the respective columns by means of pipes of smaller dimensions or the like.

The purpose according to the invention is that the working water level 10 shall be located at such a depth below the surface of the sea that the desired difference between the externally acting hydrostatic pressure and the internal caisson pressure is maintained, and thus 30 m is merely an example and moreover the tanks and form of column and methods of connection can have many embodiments without departing from the scope of the invention.

For example, a depth of 30 m corresponds to 3 at. less internal pressure in the caisson on the sea bed than the ambient hydrostatic pressure for example 20 at. at a depth of 200 m. As already described, in the case of leakages ambient sea water will penetrate into the caisson, which, even if it is filled with water, will remain at the reduced internal lower pressure as long as the caisson is connected with e.g., working water level 10. Oil which is displaced from a caisson due to leakage is passed from working oil level 11 preferably to a caisson or the like which is ready to receive oil of this kind for separation or treatment of oil/water which may to some extent have been exposed to emulsifying influences.

Emulsification rapidly takes place when hydrocarbons such as oil come into contact with water, especially at great speeds and pressures produced under the influence of pumping. A further purpose of the invention is therefore to eliminate the employment of pumps in deep water locations. This is possible by changing the static equilibrium between the water column and the oil column or the working level for water 10 and oil 11, so that the oil is lifted by the force of gravity produced by the lifting of the water column to a level somewhat lower than the working level 11 for oil whence it can be moved by means of a pump 13 to the platform deck 21 for onward transportation, or possibly downwardly to an undersea pipeline or the like. To an expert it would seem obvious to employ the hydrostatic pressure produced by the working water level 10, e.g. to transport the oil from the caisson discharge pipe directly to an oil pipeline on the sea bed for onward transportation or the like.

It is similarly a purpose of the invention to transport oil and water to and from the caissons at low speed in order to eliminate emulsification, etc. This is possible by arranging the aforesaid columns 4, 2 and 54 for oil and water respectively. The columns are of relatively large diameter, preferably 0.4 – 0.8 m. and oil and water will move very slowly to and from the caissons while at the same time the slow movement of the oil affords time for the effective closing down of liquid circulation if this should prove necessary.

The procedure for filling and emptying the caissons of oil and water respectively according to the invention will be further described below. The procedure can naturally be employed for other liquids than oil or water.

FIG. 2 shows that oil is supplied to the system via pipeline 20 to oil tank 7 and onward down into the oil column 4 which is of relatively large diameter, so that the oil assumes a low speed which is maintained preferably unchanged via manifold 17, valves 23 to distribution pipe 3 and thence via valves 25 to the respective caissons 1 in the group to be filled and which in the present example consists of four caissons. Provision for the filling and emptying of oil is arranged at the top portion 41 of the caissons. Thus the transportation of oil to storage tanks can be effected without the employment of pumps or the like. The difference in height between the water level 10 in the water tank 6 and the oil level 11 in oil tank 7 which for example during filling is somewhat higher than that indicated by the state of equilibrium between the two liquids, produces the necessary pressure so that the water 29 is displaced out of the lower ends of the caissons in the same quantity as the supply of oil 36. The water is carried via valves 26, distribution pipes 5, valve 27 in manifold 16 to column 2 for water in which the water rises at low speed into the water container 6 in which a constant liquid level 10 is maintained by means of overflow 28 or a regulating device located in overflow 28. The water at all times overflowing is fed to pump 12 which carries it up to e.g., an oil/water separator 18 preferably located on or in the platform deck 21 for the separation of any accompanying oil which is carried via pipeline 30 to the oil tank 7, while the cleaned water is discharged into the open sea indicated at 19. Where the water is sufficiently free from accompanying oil, pump 12 can feed it directly to the open sea as indicated at 31.

Under special conditions other liquids than water from the surrounding sea can be employed as displacement media. For instance the sea water displaced from the caissons can be carried to a storage tank for repeated use as a displacement medium, and anti-emulsification agents, weight-increasing agents, special liquids or the like can be added which may similarly make it desirable to reuse the water. In such cases the displacement medium will not be fed directly from the ambient sea 14, but from such above mentioned intermediate storage tanks.

When feeding oil to the caissons, pumps are only used for the movement of displaced water from the water tank 6, arranged at a relatively small depth from the surface of the sea seen in relation to the total distance from sea bed to surface at a depth of for example 200 m. Thus no oil pump is used in this operation.

Figure 3:
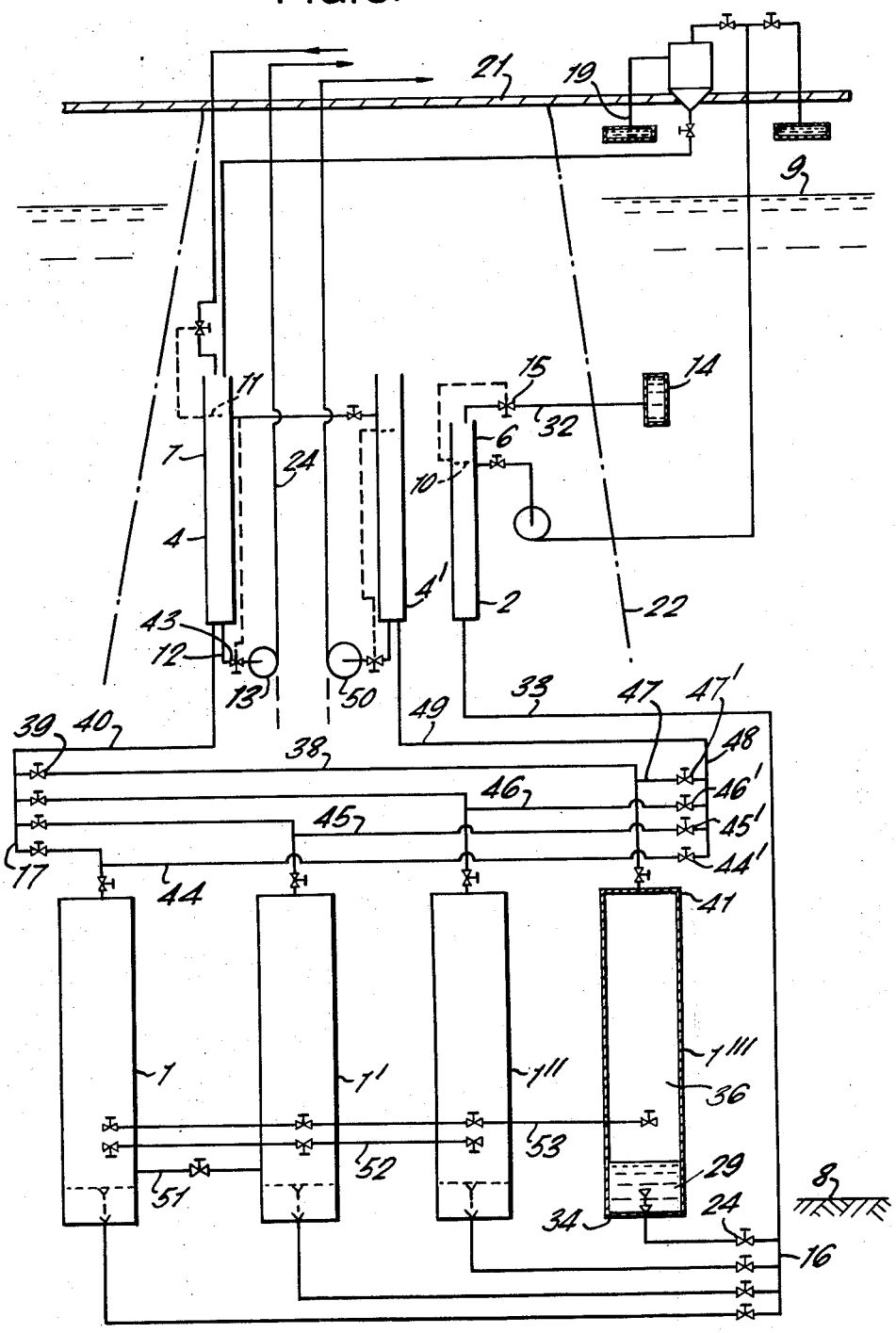
FIG. 3 is a diagrammatic illustration showing how the supply and removal of water is effected, and for the sake of simplicity this diagram shows only one caisson in each group.

The removal of oil from storage tanks and other fields of employment of the invention will be further described with reference to FIG. 3 which is a simplified embodiment without these fields of employment also being applicable according to FIG. 2. As shown in FIG. 3 water is taken from the ambient sea 14 via pipes 32 and a level-regulator valve 15 to the upper part 6 of column 2. During this operation the water level 10 is preferably maintained somewhat higher than indicated by the equilibrium level 11. The water sinks at relatively low speed via the column 2 and pipeline 33 to manifold 16 where the water is distributed to the desired caisson, in this case via valve 24 to the lower end 34 of caisson 1 ''', in which the water column 29 as it rises through the caisson displaces oil 36 out of the top 41 of the caisson, via pipe 38, valve 39 in manifold 17 and thence via pipe 40 to column 4 where the oil slowly rises towards the upper section 7 of the column to level 11. Oil from column 4 is taken to pump 13 via pipe 12 and valve 43 which may be controlled by for example a level regulator for the maintenance of oil level 11. In the example shown pump 13 is arranged for the supply of oil from the bottom section 4 of the column, but naturally the oil supply to the pump can be taken from any level below level 11. The pump 13 moves the oil up to the platform deck 21 via pipe 24 for onward transportation or for downward movement to e.g. a pipeline on the sea bed or to other suitable locations. Thus in the removal of oil from the caissons no pump is used before the oil has been lifted by gravity preferably to level 11 close to the surface of the sea and no water pump is employed during this operation.

In the case of large oil deposits where oil of varying chemical composition is fed from different oil bearing strata it will be desirable and to some extent necessary to mix oils having different chemical properties at the point of production before landing it by suitable means or using it at the point of production or the like.

The system according to the invention can be arranged for such mixing operations as shown in FIG. 3 where for example four caissons (groups) contain various types of oil which is is desired to mix to form a product. The number of columns for water 2 and oil 4 is adapted to requirements, and in the example shown column 4' is arranged to receive the oil after mixing, water being supplied in the customary way from the ambient sea 14 via pipe 32, valve 15, column 2, pipe 33 to manifold 16, where all the valves in the present example are open so that the water column 2 bears on all caissons with equal pressure. Pipe connections 44, 45, 46, 47 carry oil from the respective caissons 1, 1', 1'', 1''' to manifold 48 where respective valves 44', 45', 46', 47' for the respective pipes 44, 45, 46, 47 are regulated to allow the desired quantities of oil from the respective caissons to flow via manifold 48 and pipe 49 to column 4', whence the oil is transported in the curtomary manner by means of pump 50. As oil in varying quantities is emptied from the caissons, e.g. 10% from 1, 30% from 1', 20% from 1'' and 40% from 1''', water from manifold 16 flows into the caissons in equivalent quantities.

The described procedure is a preferred embodiment, but naturally regulation can also be effected by means of valves 44', 45', 46', 47' completely open, regulation being effected by means of water valves in manifold 16.

In FIG. 3 the pipe connections 51 shown between the caissons 1 and 1'', 52 between 1, 1' and 1'' and 53 between 1, 1', 1'', 1''' can similarly be employed for mixing purposes when oil, e.g., from column 4 is to be used as a medium for the displacement of oil from caisson 1 via pipe 52 to caisson 1'' while the water supply via manifold 16 to both caissons is turned off during such operation. Thus it is possible according to the invention to move oil without the employment of pumps to and from the various caissons by means of water as a displacement medium.

FIG. 3 also shows containers such as 2 and 4 arranged within the supporting column 22 of the platform.

Figure 4:
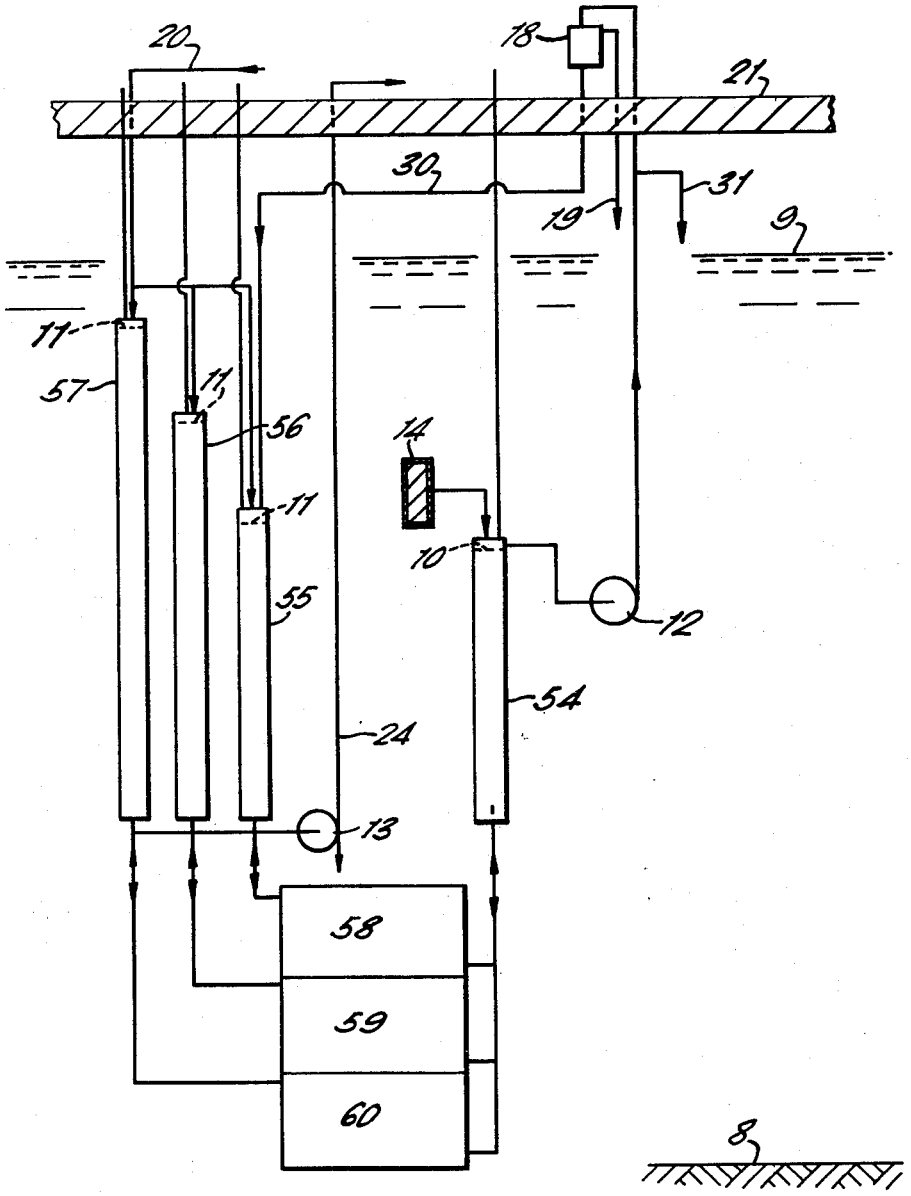
FIG. 4 is a diagrammatic illustration showing how the invention can be employed in the case of two or more separate caissons disposed one above the other.

FIG. 4 shows how the procedure in accordance with the invention is applied where two or more caissons are disposed one above the other and vertically separated from each other. Container 54 for water is situated 30 m below sea level as in the previous example while containers 55, 56, 57 are disposed one above the other at the same heights above each other as caissons 58, 59 and 60. The caissons are filled with and emptied of oil in the same way as previously described.

I claim:

1. An arrangement for the filling and emptying by gravitational means of caissons in which are stored hydrocarbons such as oil, said caissons being filled to capacity with a liquid of at least one of water and oil, said caissons being located below the level of a body of water and being anchored to the bottom thereof, at least two containers disposed below the level of the body of water and above said caissons, one of said containers being connected with said caissons through valved top portions thereof and the other of said containers being connected with said caissons through valved bottom portions thereof, said one container containing oil and having an inlet and an outlet thereon, and said other container containing water and having an inlet and an outlet thereon, whereby said caissons may be emptied of and filled with oil under the forces of gravity as the level of water in said other container is regulated to a level respectively higher and lower than the oil level in said container.

2. The arrangement according to claim 1, wherein said containers are elongated and are vertically disposed.

3. The arrangement according to claim 1, wherein at least two of said caissons are interconnected by means of valved conduits so that oils emptied therefrom may be mixed together.

4. The arrangement according to claim 1, wherein a platform deck is disposed at the level of the body of water, and two of said containers are provided which lie below said deck.

5. An arrangement for the filling and emptying by gravitational means of caissons in which are stored hydrocarbons such as oil, said caissons being filled to capacity with liquid of at least one of water and hydrocarbon, said caissons being located below a body of water and being anchored to the bottom thereunder, at least one column extending above the body of water and to which said caissons are connected, a platform carried above said body of water, at least two containers being disposed in an atmospheric compartment arranged inside said one or more columns, said containers being disposed below said body of water and above said caissons, at least one of said containers containing said hydrocarbon and having an inlet disposed below said body of water and an outlet thereon, and at least one of said containers containing water and having an inlet situated below said body of water and an outlet thereon, a first pipe communicating between the outlet of said container containing hydrocarbon and said caissons for supplying and draining stored hydrocarbons to and from said caissons, and a second pipe communicating between the outlet of said container containing water for supplying and draining water to and from said caissons, said first and second pipes being introduced in said caissons at different levels therein, whereby a pressure differential is established across a wall of said caissons equal to the hydrostatic pressure at said containers so that if leakage paths develop in said caissons, water from the body tends to be forced into said caissons rather than said hydrocarbon being forced out.

6. An arrangement according to claim 5, wherein said containers are elongated and vertically disposed so as to obtain slower velocity of said hydrocarbon and water in said containers respectively than velocity of said hydrocarbon and water in said pipes from said containers to said caissons.

7. The arrangement according to claim 6, wherein a horizontally extended container section is connected to the top portion of at least one of said elongated containers to form a container having a T-shaped vertical cross-section.

8. An arrangement according to claim 6, wherein a horizontally extended container section is disposed above and separated from at least one of said vertical containers, said two container sections being connected by means of a pipe having smaller dimensions than either of said container sections.

9. An arrangement according to claim 5, wherein draining pumps are connected to second outlets of each of said containers.

* * * * *